United States Patent [19]

Ohyama et al.

[11] Patent Number: 4,769,576

[45] Date of Patent: Sep. 6, 1988

[54] METAL VAPOR DISCHARGE LAMP

[75] Inventors: Masachika Ohyama, Himeji; Mitsuo Narita, Takasago; Kunihiro Noguchi, Himeji, all of Japan

[73] Assignee: Ushio Denki Kabushiki Kaisha, Tokyo, Japan

[21] Appl. No.: 909,671

[22] Filed: Sep. 22, 1986

[30] Foreign Application Priority Data

Oct. 4, 1985 [JP] Japan ..... 60-220325
Dec. 23, 1985 [JP] Japan ..... 60-287990

[51] Int. Cl.[4] ..... H01J 61/18; H01J 61/20

[52] U.S. Cl. ..... 313/638; 313/639; 313/642

[58] Field of Search ..... 313/638, 557, 558, 561, 313/562, 639, 642; 315/248

[56] References Cited

U.S. PATENT DOCUMENTS

| | | | |
|---|---|---|---|
| 2,701,849 | 2/1955 | Penning et al. | 313/558 |
| 3,319,119 | 5/1967 | Rendina | 315/248 |
| 3,740,605 | 6/1973 | Divoix et al. | 313/641 |
| 3,867,665 | 2/1975 | Furmidge et al. | 313/485 |
| 4,155,025 | 5/1979 | Dobrusskin et al. | 313/642 X |
| 4,158,789 | 6/1979 | Scholz et al. | 313/633 |
| 4,360,758 | 11/1982 | Thornton, Jr. et al. | 313/642 X |

FOREIGN PATENT DOCUMENTS

| | | | |
|---|---|---|---|
| 2139078 | 3/1972 | Fed. Rep. of Germany | 313/640 |
| 0101329 | 6/1982 | Japan | 313/638 |

OTHER PUBLICATIONS

Author: Browner et al., Title: Improvements in Electrodeless Discharge Lamp Radiant Flux and Stability by Precise Temperature Control, Date: 3/7/72 p.: 5.

*Primary Examiner*—David K. Moore
*Assistant Examiner*—Michael Horabik
*Attorney, Agent, or Firm*—Robert F. Ziems

[57] ABSTRACT

A metal vapor discharge lamp includes a light-emitting tubing in which a halogen and iron at least 0.005 mg per cc of the internal volume of the light-emitting tubing are filled together with mercury and a rare gas in amounts sufficient to retain a discharge. Magnesium is additionally filled in at a magnesium-to-iron ratio of 1/40–⅔ in terms of gram atom number so as to prevent iron from depositing on the inner wall of the light-emitting tubing and forming a thin film thereon.

3 Claims, 2 Drawing Sheets

METAL VAPOR DISCHARGE LAMP

BACKGROUND OF THE INVENTION (1) Field of the Invention:

This invention relates to metal vapor discharge lamps useful in photochemical reactions or for hardening paints and inks.

(2) Description of the Prior Art:

Ultraviolet rays are often used to induce photochemical reactions or to harden paints and inks. For these purposes, ultraviolet rays having a wavelength range of about 280–400 nm are effective.

As sources for such ultraviolet rays, electrode-type high-pressure mercury vapor discharge lamps in each of which a discharge takes place between its electrodes have conventionally been used. Furthermore, electrodeless high-pressure mercury vapor lamps have also been known recently, in each of which mercury and a rare gas are filled in amounts sufficient to retain a discharge within an electrodeless light-emitting tubing, and electromagnetic waves such as high-frequency waves of several tens MHz or higher or microwaves are externally irradiated to the tubing so as to excite the internally-filled mixture and to produce a discharge as light.

By the way, each of these electrode-type or electrodeless high-pressure mercury vapor lamps emits light having a line spectrum which comprises a number of peaks and extends over a considerably wide wavelength range. It is therefore inefficient to use high-pressure mercury vapor lamps for photochemical reactions or hardening of paints, which require the above-mentioned range as an effective wavelength range. Accordingly, there are often employed metal vapor discharge lamps in each of which a metal halide is filled as a light-emitting material within the light-emitting tubing so as to increase the light quantity of a specific effective wavelength range. Metal vapor discharge lamps in which iron is filled are particularly convenient for such purposes as photochemical reactions and hardening of paints, because the lights from these lamps is continuously emitted in the range of the 350–400 nm.

When a metal vapor discharge lamp filled with iron in an amount of enough to provide an iron-related spectrum of sufficient intensity is lit over many hours, iron is caused to deposit on the inner wall of its light-emitting tubing so that a thin film is formed thereon. For this reason, the amount of iron which contributes to the emission of light decreases and at the same time, the thus-formed thin film prevents the transmission of ultraviolet rays, leading to a problem that the output of ultraviolet rays is reduced.

With a view toward improving this problem, it has been proposed to additionally incorporate and fill lead within a metal vapor discharge lamp which contains iron therein (Japanese Utility Model Publication No. 15503/1979). Although such an addition of lead can prevent the formation of a thin iron film and can retain the output of ultraviolet rays as intended, the output of large bright lines of 302 nm, 313 nm and 365 nm from mercury is extremely weakened by the thus-added lead. It is hence not desirable to add lead. Such lead-added metal vapor discharge lamps are not suited for such purposes as photochemical reactions or hardening of paints.

It has also been known to add tin. Similar to lead, tin is accompanied by a drawback that the output of the line spectrum of mercury is lowered to a significant extent.

SUMMARY OF THE INVENTION

An object of this invention is to provide a metal vapor discharge lamp capable of preventing the deposition of iron on the inner wall of its light-emitting tubing without giving any adverse effects to the emission spectra of mercury and iron so that the output of ultraviolet rays is retained over many hours.

With a view toward attaining the above object of this invention, the present inventors found that it is effective to additionally fill magnesium in a metal vapor discharge lamp containing at least 0.005 mg/cc of iron within its light-emitting tubing. A variety of experiments has then been conducted on the basis of this finding, leading to completion of the present invention.

In one aspect of this invention, there is thus provided a metal vapor discharge lamp comprising a light-emitting tubing in which a halogen and iron at least 0.005 mg per cc of the internal volume of the light-emitting tubing are filled together with mercury and a rare gas in amounts sufficient to retain a discharge. Magnesium is additionally filled in at a magnesium-to-iron ratio of 1/40–$\frac{2}{3}$ in terms of gram atom number so as to prevent iron from depositing on the inner wall of the light-emitting tubing and forming a thin film thereon.

The term "tubing" as used herein should be interpreted in a broad sense provided that the object of this invention is attained. The term "tubing" may therefore embrace, for example, tubes, bulbs and the like.

In the present invention, magnesium is added and in such an amount as attaining a magnesium-to-iron ratio of 1/4014 $\frac{1}{4}$ in terms of gram atom number in a metal vapor discharge lamp within which iron is in an amount of at least 0.005 mg per cc of its light-emitting tubing. It is therefore possible to obtain light from mercury and iron without giving any substantial deleterious effects to the outputs of the emission spectra of mercury and iron and hence to use the light as is. Owing to the combined filling of magnesium, iron is prevented from its deposition on the inner wall of the light-emitting tubing and no thin film is formed. The output of light having wavelengths in the range of 280–400 nm is hence not lowered even when the lamp is lit over many hours. The lamp of this invention can therefore be used as an electrodeless metal vapor discharge lamp suitable as an ultraviolet ray source for inducing photochemical reactions or hardening paints, inks or the like.

BRIEF DESCRIPTION OF THE DRAWINGS

The above and other objects, features and advantages of the present invention will become apparent from the following description of the invention and appended claims, taken in conjunction with the appended drawings, in which:

DETAILED DESCRIPTION OF THE INVENTION AND PREFERRED EMBODIMENTS

Magnesium may be suitably filled in an amount within the above-specified range. If it is added in any amounts smaller than 1/40 in terms of its gram atom number ratio to iron, the output of ultraviolet rays cannot be sufficiently retained. On the other hand, any amounts greater than $\frac{2}{3}$ develops an inconvenience that the emission spectrum of iron becomes somewhat weaker. If the amount of sealed iron is less than 0.005 mg/cc relative to the internal volume of the light-emitting tubing, no iron-related spectrum can be obtained to any sufficient extent.

Figure 1:
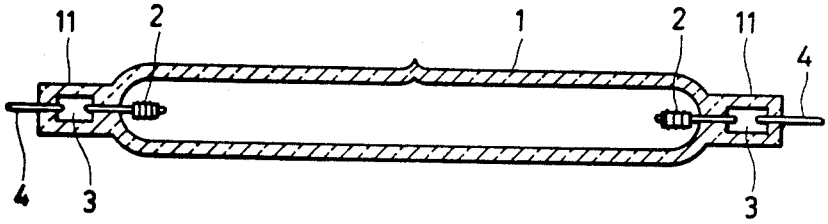
FIG. 1 is a longitudinal cross-section of an electrode-type metal vapor discharge lamp according to one embodiment of this invention.

Referring now to FIG. 1, the rated power consumption of the metal vapor discharge lamp is 4 KW. It is useful as a light source for photochemical reactions. A pair of electrodes 2,2 are disposed in an opposing relation within a light-emitting tube 1 which has an internal diameter of 22 mm and an internal volume of 100 cc and is made of fused quartz. The electrode interval is 250 mm. Sealed portions 11 are provided at both ends of the light-emitting tube 1. Within each of the sealed portions 11, there is sealed a molybdenum foil 3 via which an outer lead 4 is electrically connected to its associated electrode 2. Fillings within the light-emitting tube 1 are 120 mg of metal mercury, 13 mg of mercury iodide, 5 mg (0.05 mg/cc) of iron, 0.2 mg of magnesium and 15 mmHg of argon gas, whereby the metal vapor discharge lamp is constructed. The ratio of this magnesium to the iron is 1/11 in terms of gram atom number.

Figure 2:
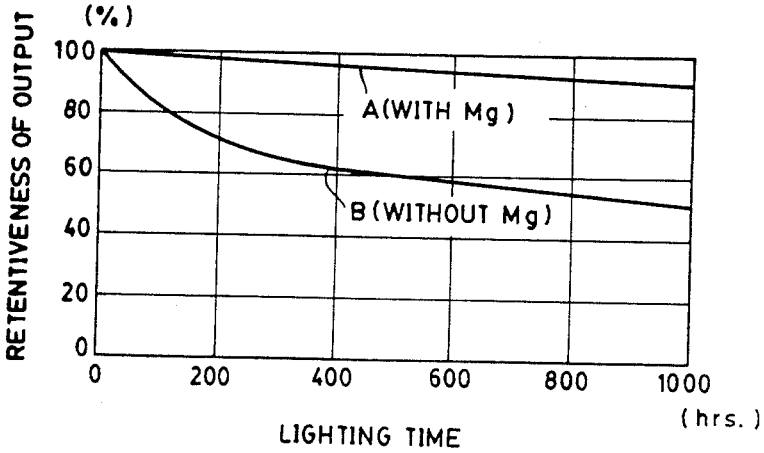
FIG. 2 is a characteristic curve of the retentiveness of output of the discharge lamp of FIG. 1.

When the metal vapor discharge lamp was lit, the lamp current and voltage were 12.3 A and 362 V respectively at a power consumption of 4 KW. It was lit up to 1,000 hours. No iron was allowed to deposit at all on the inner wall of the light-emitting tube 1 and no thin iron film was hence formed. During the lighting, variations were measured with respect to the output of ultraviolet rays in the wavelength range of 280–400 nm. As shown by Characteristic Curve A in FIG. 2, the retentiveness of the output was as high as 90% even after 1,000 hours.

Further, a control metal vapor discharge lamp which was the same as the metal vapor discharge lamp of this embodiment except for the omission of magnesium was also subjected to a similar lighting experiment for the sake of comparison. Iron started depositing on the inner wall of its light-emitting tube after an elapsed time of several tens hours or so, so that a thin film was formed. The retentiveness of its output dropped to 50% in 1,000 hours as shown by Characteristic Curve B in FIG. 2.

In addition, the influence to the output of the line spectrum of mercury and the output of the spectrum of iron by the addition of magnesium was also investigated. In the case of the metal vapor discharge lamp of this embodiment, the intensity of the spectrum of mercury dropped by only 3% and the intensity of the spectrum of iron decreased by 5% only. Hence, these reductions were small. In the case of the metal vapor discharge lamps in which lead and tin were respectively added in place of magnesium of the present embodiment, the intensity of the spectrum of mercury dropped by 35% (with lead) and 28% (with tin). It was also found that the combined addition of magnesium and iron does not give any substantial effects to the outputs of spectra of mercury and iron.

Further, the additional incorporation of magnesium did not give any substantial effects to electric characteristics such as starting voltage, reignition voltage and the like.

In the fabrication of the metal vapor discharge lamp of this embodiment, iron was added in the form of metal iron while magnesium was added in the form of metal magnesium. They may however be incorporated in the forms of an iron halide and a magnesium halide respectively. Needless to say, the same effects can also be brought about even when they are added as a mixture.

Figure 3:
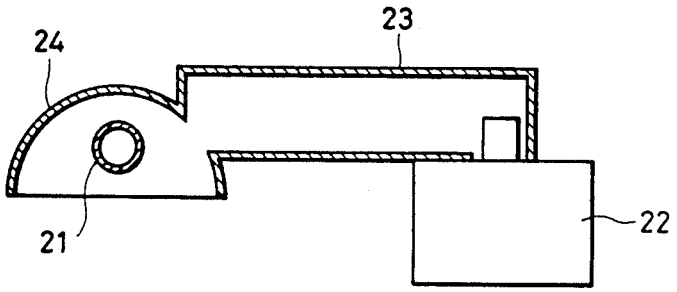
FIG. 3 is a schematic cross-sectional view of a light source unit for photochemical reactions, in which an electrodeless metal vapor discharge lamp according to another embodiment of this invention is incorporated.

Referring next to FIG. 3, the rated output of a magnetron 22 is 1.5 KW. The magnetron 22 generates microwaves having a wavelength of 2,450 MHz. These microwaves are guided into a reflector 24 through a waveguide 23. Within the reflector 24, the electrodeless metal vapor discharge lamp constructed of a spherical light-emitting bulb 21 made of fused quartz is disposed. Microwaves are irradiated to the lightemitting bulb 21. The frequency of microwaves is not limited to the above-mentioned frequency. Any high frequencies of several tens MHz and higher may be successfully employed.

The inner diameter of the light-emitting bulb 21 is 22 mm and its internal volume is about 5.6 cc. The light-emitting bulb 21, is filled with 6 mg of metal mercury, 2.6 mg of mercury iodide, 1 mg (0.179 mg/cc) of iron, 0.04 mg of magnesium and 10 mmHg of argon gas. The amount of the added magnesium is 1/11 in terms of gram atom number ratio relative to the iron.

Figure 4:
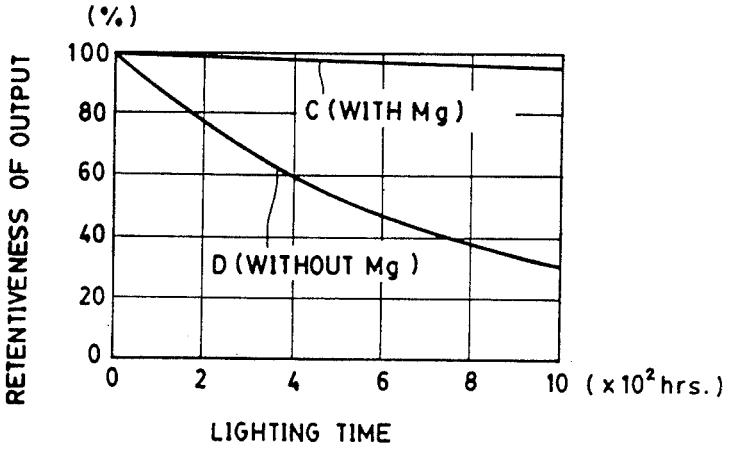
FIG. 4 is a characteristic curve of the retentiveness of output of the discharge lamp of FIG. 3.

When microwaves were irradiated to the light-emitting bulb 21, the mixture filled within the bulb 21 was excited to produce a discharge, thereby being lit. Even when lit up to 1,000 hours, iron did not deposit at all on the inner wall of the light-emitting bulb 21 and no thin iron film was formed. During this lighting, variations were measured in connection with the output of ultraviolet rays of wavelengths in the range of 280–400 nm. As shown by Characteristic Curve C in FIG. 4, the retentiveness of the output was as high as 97% even after 1,000 hours.

Incidentally, an electrodeless metal vapor discharge lamp which was the same as the electrodeless metal vapor discharge lamp in this embodiment except for the omission of magnesium was subjected to a lighting experiment for the sake of comparison. Iron started depositing on the inner wall of the light-emitting bulb after an elapsed time of about several tens hours and a thin film was formed. The retentiveness of the output dropped to 30% after 1,000 hours as shown by Characteristic Curve D in FIG. 4.

Having now fully described the invention, it will be apparent to one of ordinary skill in the art that many changes and modifications can be made thereto without departing from the spirit or scope of the invention as set forth herein.

We claim:

1. In a metal vapor discharge lamp including a light-emitting tubing having an inner surface defining an internal lamp volume, the improvement comprising:

a fill including a halogen, iron in an amount of at least 0.005 mg per cc of the internal lamp volume, mercury, a rare gas and magnesium at a magnesium-to-iron ratio in the range of 1/40–2/3 in terms of gram atom number, whereby iron is prevented from depositing as a thin film on the inner surface of the light-emitting tubing without substantially reducing mercury and iron light emission in a wavelength range of about 280–400 nm.

2. The discharge lamp as claimed in claim 1, wherein the light-emitting tubing is equipped with discharge electrodes for producing an arc discharge.

3. The discharge lamp as claimed in claim 1, wherein the discharge lamp is an electrodeless discharge lamp of such type that electromagnetic waves are externally irradiated to the light-emitting tubing, whereby the mixture of the halogen, iron, mercury and rare gas filled within the light-emitting tubing is excited to give off a discharge as light.

* * * * *